United States Patent [19]

Kepiro

[11] 4,422,219

[45] Dec. 27, 1983

[54] BUCKLE

[76] Inventor: Joseph Kepiro, R.D. #2, Parkesburg, Pa. 19365

[21] Appl. No.: 394,315

[22] Filed: Jul. 1, 1982

[51] Int. Cl.[3] ..... A44B 11/24; B68B 5/00

[52] U.S. Cl. ..... 24/176; 24/188

[58] Field of Search ..... 24/176, 178, 186, 188, 24/189

[56] References Cited

U.S. PATENT DOCUMENTS

| | | | |
|---|---|---|---|
| 482,764 | 9/1892 | Stewart | 24/186 |
| 492,445 | 2/1893 | Sweetland | 24/178 R |
| 699,074 | 4/1902 | Buttman | 24/178 R |
| 720,201 | 2/1903 | White | 24/176 |
| 731,808 | 6/1903 | Nock et al. | 24/176 |
| 869,927 | 11/1907 | McBride | 24/188 |
| 881,462 | 3/1908 | Craig | 24/176 |
| 961,347 | 6/1910 | Hall | 24/188 |
| 1,058,493 | 4/1913 | Tenny | 24/178 R |
| 2,884,675 | 5/1959 | Sternschuss | 24/176 |

FOREIGN PATENT DOCUMENTS

| | | | |
|---|---|---|---|
| 251201 | 10/1947 | Sweden | 24/178 R |

*Primary Examiner*—Paul J. Hirsch

[57] ABSTRACT

The invention is directed to a buckle and the method of making the same. The buckle is formed from a rectangular bent wire element having positioned perpendicular therefrom at the midregion thereof a second element forming the strap post and strap keeper.

1 Claim, 2 Drawing Figures

BUCKLE

BACKGROUND OF THE INVENTION

1. Field of the Invention

The invention is directed to a buckle and, more particularly, a buckle formed of two shaped, bent wire elements.

2. Description of the Prior Art

U.S. Pat. No. 720,201 discloses a buckle with the two sides of the buckle, opposite the strap post 11, being inclined at an obtuse angle.

U.S. Pat. No. 731,808 discloses a buckle with the two sides of the buckle, opposite the strap post 5, being inclined at an obtuse angle. A strap keeper 4 is positioned perpendicular to the buckle main body and is positioned above the strap post.

SUMMARY OF THE INVENTION

The buckle is formed from a first bent wire element that has a single wire bent in the shape of a rectangle with the two ends of the wire fastened together. The rectangle is then bent at the midregion of its two long sides to form two obtuse angle intersecting planes containing in each plane one-half of the rectangle. A second generally dome-shaped bent wire element is positioned perpendicular to the first wire element at the midregion of the two long sides. One end of the second wire element extends into the plane of said second wire element and forms a strap post projecting above the intersection of the two planes of the first wire element. The three sides of the second element arc above the strap post to form the strap keeper of the buckle.

DESCRIPTION OF THE PREFERRED EMBODIMENT

Figure 1:
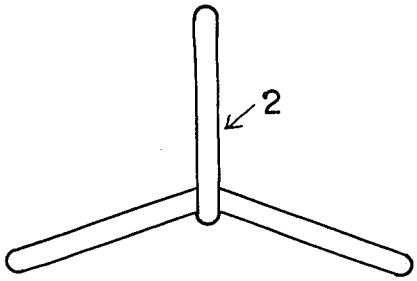
FIG. 1 is a side view of the buckle.
Figure 2:
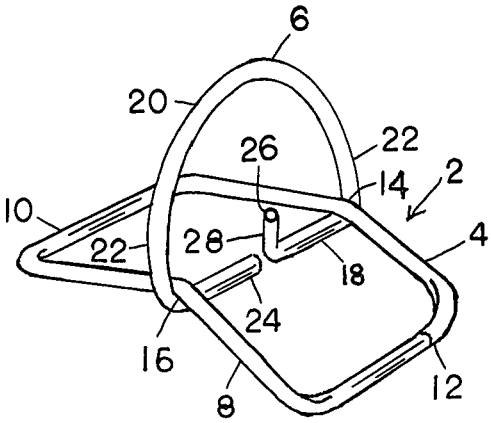
FIG. 2 is a perspective view of the buckle.

The buckle 2, shown in FIG. 2, is composed of a first bent wire element 4 and a second bent wire element 6. The first element 4 is generally rectangular in shape with a long side 8 and short side 10. The two ends of the wire are fastened together at point 12. The rectangular shaped element 4 is then bent at the midregion 14 of the long side 8 to form two halves which are each in a plane and these planes intersect at the midregion 14 with an obtuse angle 16 at the point of intersection.

The second bent wire element 6 is generally of a dome shape. It really has a straight long side 18, a curved long side 20 and two short sides 22. One end 24 of the wire forming element 6 may be fastened to the other end of the wire just about three-quarters of an inch below the other end 26 of the wire. The portion of the wire adjacent end 26 is bent into the plane of element 6 and forms the strap post 28 of the buckle as shown in FIG. 2.

The second wire element 6 is positioned perpendicular to the first wire element 4 at the midregion 14 of its two long sides 8. The long side 18 of element 6 is fastened to the midregion of the sides 8 of element 4 in the area of the obtuse angle 16 and this results in the end 26 of element 6 projecting upward from the center of the rectangular shaped element 4 to form the strap post 28 of the buckle. The long side 20 of element 6 curves over the post 28 to form the strap keeper of the buckle.

The ends of the two elements may be fastened together and the elements themselves are fastened together by welding or brazing.

What is claimed is:

1. A method of making a buckle comprising:

(a) bending a first wire with two ends into a generally rectangular shape with two long sides and two short sides and fastening together said two ends, (b) bending the rectangular shape at the midregion of the two long sides to form an obtuse angle between the two long sides, (c) bending a second wire with two ends into a generally dome-shaped second shape with one straight long side, one curved long side and two short sides, (d) bending one end of said second wire into the area and plane of said second shape so formed at the midregion of said long straight side, (e) fastening the second wire to the first wire with the long side of the second wire having the bent end positioned at the midpoint of the two long sides of the first wire, and said bent end extending perpendicular to a plane parallel to and intersecting with the two short sides of the first wire and away from the obtuse angle of that first wire.

* * * * *